US007919921B2

(12) United States Patent
Kyushima et al.

(10) Patent No.: US 7,919,921 B2
(45) Date of Patent: Apr. 5, 2011

(54) PHOTOMULTIPLIER

(75) Inventors: Hiroyuki Kyushima, Hamamatsu (JP); Hideki Shimoi, Hamamatsu (JP); Hiroyuki Sugiyama, Hamamatsu (JP); Hitoshi Kishita, Hamamatsu (JP); Suenori Kimura, Hamamatsu (JP); Yuji Masuda, Hamamatsu (JP); Takayuki Ohmura, Hamamatsu (JP)

(73) Assignee: Hamamatsu Photonics K.K., Hamamatsu-shi, Shizuoka (JP)

( * ) Notice: Subject to any disclaimer, the term of this patent is extended or adjusted under 35 U.S.C. 154(b) by 406 days.

(21) Appl. No.: 11/921,944

(22) PCT Filed: Jun. 1, 2006

(86) PCT No.: PCT/JP2006/311010

§ 371 (c)(1),
(2), (4) Date: Dec. 11, 2007

(87) PCT Pub. No.: WO2007/020741

PCT Pub. Date: Feb. 22, 2007

(65) Prior Publication Data

US 2009/0224666 A1 Sep. 10, 2009

(30) Foreign Application Priority Data

Aug. 12, 2005 (JP) ..... P2005-234728

(51) Int. Cl.
*H01J 43/18* (2006.01)

(52) U.S. Cl. ..... 313/533; 313/532

(58) Field of Classification Search ..... 313/532–536; 330/42

See application file for complete search history.

(56) References Cited

U.S. PATENT DOCUMENTS

| | | | | |
|---|---|---|---|---|
| 5,264,693 | A | 11/1993 | Shimabukuro et al. | |
| 5,329,110 | A | 7/1994 | Shimabukuro et al. | |
| 5,568,013 | A | 10/1996 | Then et al. | |
| 6,384,519 | B1 * | 5/2002 | Beetz et al. | 313/103 CM |
| 7,049,747 | B1 | 5/2006 | Goodberlet et al. | |
| 7,294,954 | B2 | 11/2007 | Syms | |

FOREIGN PATENT DOCUMENTS

| | | |
|---|---|---|
| JP | 4-359855 | 12/1992 |
| JP | 3078905 | 6/2000 |
| WO | WO 2005/078760 | 8/2005 |

* cited by examiner

*Primary Examiner* — Nimeshkumar D Patel
*Assistant Examiner* — Christopher M Raabe
(74) *Attorney, Agent, or Firm* — Drinker Biddle & Reath LLP

(57) ABSTRACT

The present invention relates to a photomultiplier having a fine structure capable of realizing high multiplication efficiency. The photomultiplier comprises a housing whose inside is maintained vacuum, and, on a device mounting surface which is a part of an inner wall surface defining an internal space of the housing, a photocathode serving as a reflection type photocathode, an electron-multiplier section, an anode, and a voltage distributing section are disposed integrally. In particular, the electron-multiplier section is constituted by dynodes at multiple stages cascade-multiplying photoelectrons from the photocathode, and the voltage distributing section, which applies corresponding voltages to the dynodes at the respective stages respectively, is on the same surface together with the electron-multiplier section.

7 Claims, 8 Drawing Sheets

(a)

(b)

(a)

(b)

PHOTOMULTIPLIER

TECHNICAL FIELD

The present invention relates to a photomultiplier which has an electron-multiplier section to carry out cascade-multiplication of photoelectrons generated by a photocathode.

BACKGROUND ART

Conventionally, photomultipliers (PMT: Photo-Multiplier Tube) have been known as optical sensors. A photomultiplier comprises a photocathode that converts light into electrons, a focusing electrode, an electron-multiplier section, and an anode, and is constituted so as to accommodate those in a vacuum case. In such a photomultiplier, when light is made incident into a photocathode, photoelectrons are emitted from the photocathode into a vacuum case. The photoelectrons are guided to an electron-multiplier section by a focusing electrode, and are cascade-multiplied by the electron-multiplier section. An anode outputs, as signals, electrons having reached among multiplied electrons (for example, see the following Patent Document 1 and Patent Document 2).

Patent Document 1: Japanese Patent No. 3078905 (Japanese Patent Application Laid-Open No. 5-182631)

Patent Document 2: Japanese Patent Application Laid-Open No. 4-359855

DISCLOSURE OF THE INVENTION

Problems that the Invention is to Solve

The inventors have studied the conventional photomultiplier in detail, and as a result, have found problems as follows. That is, as optical sensors expand in application, smaller photomultipliers are desired. On the other hand, accompanying such downsizing of photomultipliers, a high-precision processing technology has been required for components constituting the photomultipliers. In particular, when the miniaturization of components themselves is advanced, it is increasingly more difficult to realize an accurate layout among the components, which makes it impossible to obtain high detection accuracy, and leads to a great variation in detection accuracy of each of the manufactured photomultipliers.

The present invention is made to solve the aforementioned problem, and it is an object to provide a photomultiplier having a fine structure capable of obtaining higher multiplication efficiency.

Means for Solving the Problems

A photomultiplier according to the present invention is an optical sensor having an electron-multiplier section cascade-multiplying photoelectrons generated by a photocathode, and depending on a layout position of the photocathode, there is a photomultiplier having a transmission type photocathode emitting photoelectrons in a direction which is the same as an incident light direction, or a photomultiplier having a reflection type photocathode emitting photoelectrons in a direction different from the incident light direction.

In concrete terms, the photomultiplier comprises a housing whose internal space, defined by an inner wall surface including a device mounting surface, is maintained in a vacuum state, and further comprises a photocathode accommodated in the housing, an electron-multiplier section accommodated in the housing, an anode accommodated at least partially in the housing, and a voltage distributing section. The housing is constituted by a lower frame comprised of a glass material, a sidewall frame in which the electron-multiplier section, the anode, and the voltage distributing section are integrally etched, and an upper frame comprised of a glass material or a silicon material. Note that the device mounting surface corresponds to the upper surface of the lower frame.

The electron-multiplier section is constituted by dynodes at multiple stages sequentially disposed along an electron traveling direction on the device mounting surface, and these dynodes at multiple stages are respectively set to different electric potentials. It is possible to realize high multiplication efficiency due to cascade-multiplication by such dynodes at multiple stages. Further, the voltage distributing section is disposed on the device mounting surface along with the electron-multiplier section, and applies a predetermined voltage to each of the respective dynodes at multiple stages constituting the electron-multiplier section. In this way, due to the electron-multiplier section and the device mounting surface being disposed together on the same surface, it is possible to downsize the photomultiplier.

In the photomultiplier according to the present invention, since the voltage distributing section is accommodated together with the electron-multiplier section in the internal space of the housing, the voltage distributing section is preferably in a shape having a main shaft part and a plurality of connection parts extending from the main shaft part. The main shaft part extends along an electron traveling direction in the electron-multiplier section, and one ends of the plurality of connection parts are connected to a dynode at a corresponding stage among the dynodes at multiple stages. Furthermore, each connection part is preferably formed such that at least a thickness defined in a direction in which the main shaft part extends at a joint end with the main shaft part is made less than a width of a dynode at each stage defined in the direction in which the main shaft part extends. This is because, a continuous electric potential gradient is formed in the main shaft part in which predetermined voltages have been applied to the both ends, in a case in which a thickness of the joint end of a connection part (a joint portion between the main shaft part and the connection part) is great, an electric potential difference generated between a side face facing the photocathode side of the connection part and a side face facing the anode side is made unignorable (it is difficult to control an electric potential of a dynode at a corresponding stage). Conversely, a cross-section of the connection part except for the joint end is preferably made greater in order to reduce electric resistance.

In the photomultiplier according to the present invention, each of the respective dynodes at multiple stages preferably has a plurality of groove portions disposed along the device mounting surface. Respective groove portions of one dynode constitute a part of each of a plurality of electron-multiplier channels.

In addition, in the photomultiplier according to the present invention, metal terminals to apply predetermined voltages to the electron-multiplier section are connected to the both ends of the main shaft part in the above-described voltage distributing section. These metal terminals are inserted into through-holes through which the outside and the internal space of the housing are communicated with one another.

Note that, in the photomultiplier according to the present invention, at least the above-described electron-multiplier section is preferably comprised of silicon because of its ease of process. For example, when the sidewall frame is comprised of a silicon material, because the electron-multiplier section, the anode, and the voltage distributing section can be realized by integrally-etching, two-dimensional layout of these components on the device mounting surface of the lower frame is possible, which makes it possible to downsize the photomultiplier.

The present invention will be more fully understood from the detailed description given hereinbelow and the accompanying drawings, which are given by way of illustration only and are not to be considered as limiting the present invention.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will be apparent to those skilled in the art from this detailed description.

Effects of the Invention

As described above, in accordance with the present invention, an electron-multiplier section realizing high multiplication efficiency, which is constituted by dynodes at multiple stages respectively having a plurality of groove portions constituting a part of an electron-multiplier channel, and a voltage distributing section applying predetermined voltages to these dynodes at multiple stages are disposed on the same surface. In this way, because the main components of the photomultiplier can be disposed two-dimensionally, it is possible to obtain a photomultiplier having a fine structure capable of obtaining higher multiplication efficiency.

DESCRIPTION OF THE REFERENCE NUMERALS

1*a*: photomultiplier; 2: upper frame; 3: sidewall frame; 4: lower frame (glass substrate); 22: photocathode; 31: electron-multiplier section; 32: anode; 42: anode terminal; 311: voltage distributing section; and 311*a*, 311*b*: ends.

BEST MODES FOR CARRYING OUT THE INVENTION

In the following, a photomultiplier and a method for manufacturing the same according to the present invention will be explained by using FIGS. 1 to 8. In the explanation of the drawings, constituents identical to each other will be referred to with numerals identical to each other without repeating their overlapping descriptions.

Figure 1:
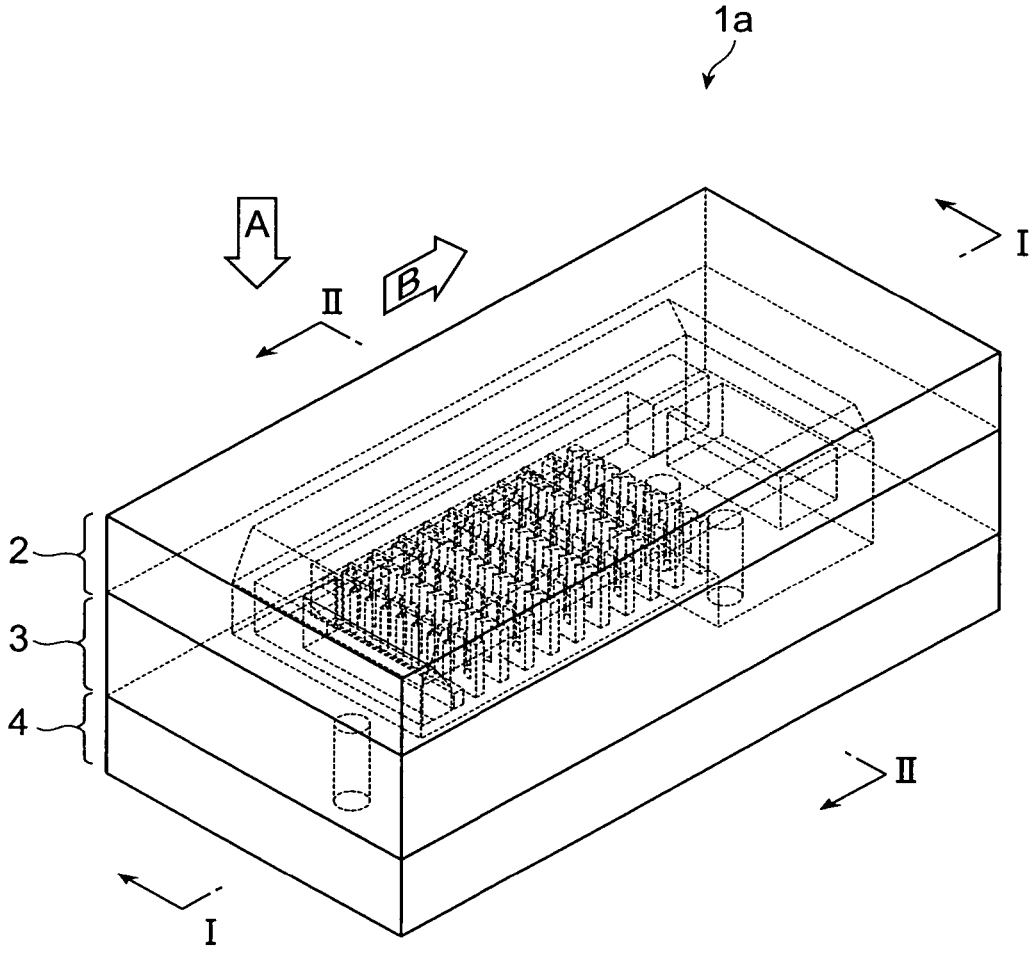
FIG. 1 is a perspective view showing a configuration of one embodiment of a photomultiplier according to the present invention.

FIG. 1 is a perspective view showing a configuration of one embodiment of the photomultiplier according to the present invention. A photomultiplier 1*a* shown in FIG. 1 is a photomultiplier having a reflection type photocathode, and comprises a housing constituted by an upper frame 2 (a glass substrate), a sidewall frame 3 (a silicon substrate), and a lower frame 4 (a glass substrate). The photomultiplier 1*a* is a photomultiplier in which a direction of incident light to the photocathode and an electron traveling direction in the electron-multiplier section cross each other, i.e., when light is made incident from a direction indicated by an arrow A in FIG. 1, photoelectrons emitted from the photocathode are made incident into the electron-multiplier section, and cascade-multiplication of secondary electrons is carried out due to the photoelectrons traveling in a direction indicated by an arrow B. Continuously, the respective components will be described.

Figure 2:
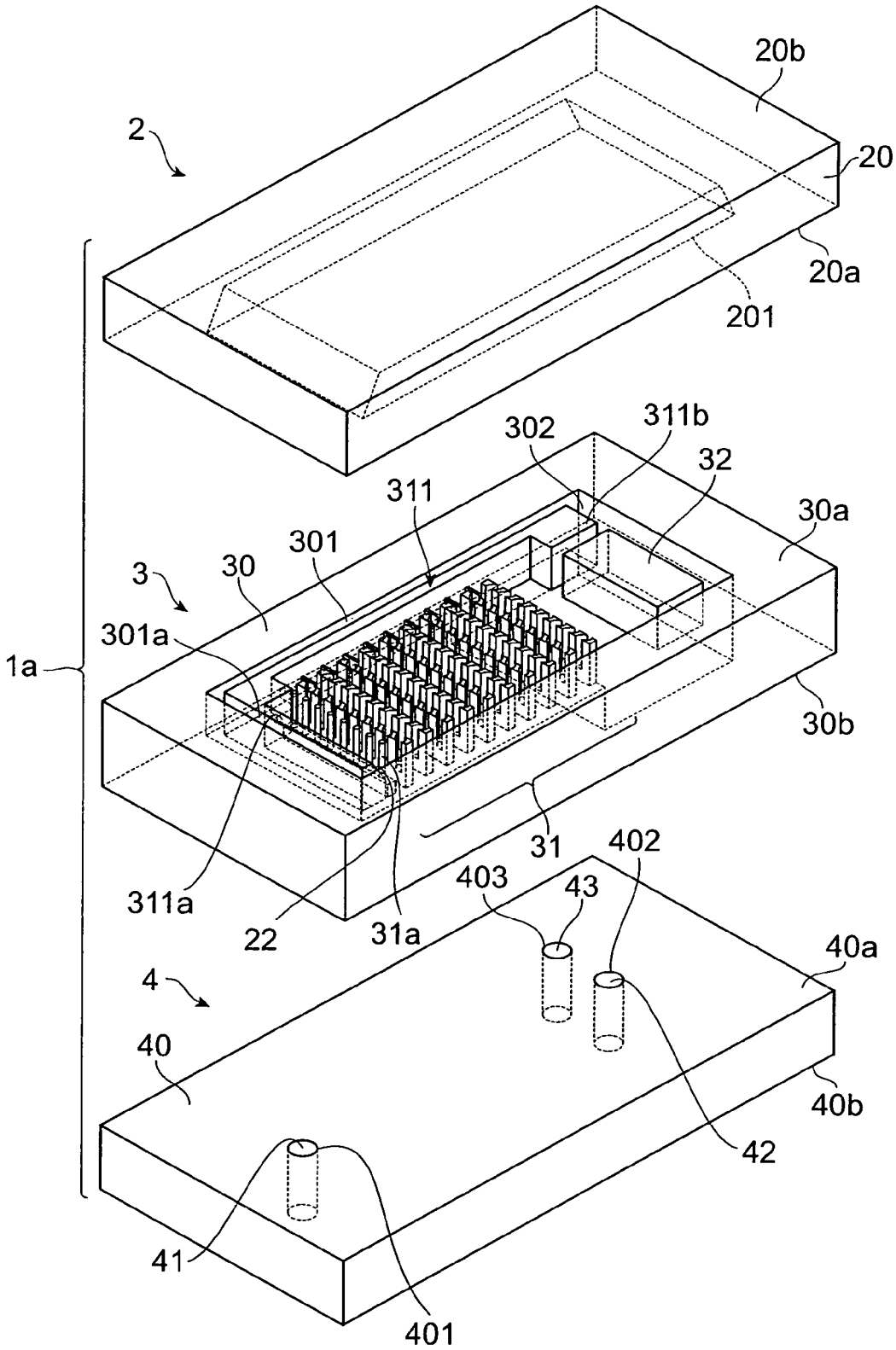
FIG. 2 is an assembly process drawing of the photomultiplier shown in FIG. 1.

FIG. 2 is a perspective view showing the photomultiplier 1*a* shown in FIG. 1 so as to be disassembled into the upper frame 2, the sidewall frame 3, and the lower frame 4. The upper frame 2 is comprised of a rectangular flat plate shaped glass substrate 20 serving as a base material. A process for a rectangular depressed portion 201 is formed on a main surface 20*a* of the glass substrate 20, and the periphery of a depressed portion 201 is formed along the periphery of the glass substrate 20.

The sidewall frame 3 is constituted by a rectangular flat plate shaped silicon substrate 30 serving as a base material. A penetration portion 301 (at the electron-multiplier section 31 side) and a penetration portion 302 (at the anode 32 side) are constituted by a main surface 30*a* of the silicon substrate 30 toward a surface 30*b* facing it. The both openings of the penetration portion 301 and the penetration portion 302 are rectangular, and the penetration portion 301 and the penetration portion 302 are coupled with one another, and the peripheries thereof are formed along the periphery of the silicon substrate 30.

A reflection type photocathode 22, the electron-multiplier section 31, an anode 32, and a voltage distributing section 311 are formed in the penetration portion 301. The electron-multiplier section 31 is constituted by dynodes at multiple stages set to different electric potentials from the photocathode 22 toward the anode 32. The groove portions including a bottom are formed at each of the dynodes at multiple stages, and secondary electron emission surfaces formed of secondary electron emission materials are formed at these wall parts (side walls defining the respective groove portions) and the bottom.

Furthermore, the voltage distributing section 311 and the anode 32 are disposed to provide a void part from an inner wall of the penetration portion 302 in the penetration portion 302. The voltage distributing section 311 is constituted by a main shaft part extending along an electron traveling direction in the electron-multiplier section 31, and connection parts which extend from the main shaft part and whose one ends are connected to dynodes at corresponding stages. In addition, a predetermined voltage is applied between a first end 311*a* and a second end 311*b* of the voltage distributing section 311, and a dynode at each stage in the electron-multiplier section 31 is set to a predetermined electric potential by a connection part. A part of the photocathode side terminal 311*a* is cut obliquely with respect to a direction of incident light (in the direction indicated by the arrow A in FIG. 1) so as to face the anode 32, and the reflection type photocathode 22 is formed on this cut surface. The anode 32 is disposed at a position to sandwich the electron-multiplier section 31 along with the photocathode 22. These photocathode 22, electron-multiplier section 31, voltage distributing section 311, and anode 32 are respectively fixed to the lower frame 4 by anode joining, diffusion joining, and still further joining using a sealing material such as low melting metal (for example, indium, etc.), or the like (hereinafter, a case merely described as joining denotes any one of these joining methods), and thereby being disposed on the device mounting surface of the lower frame 4 two-dimensionally.

The lower frame 4 is comprised of a rectangular flat plate shaped glass substrate 40 serving as a base material. A hole 401, a hole 402, and a hole 403 are respectively provided from a main surface 40*a* (the device mounting surface) of the glass substrate 40 toward a surface 40*b* facing it. A photocathode side terminal 41, an anode terminal 42, and an anode side terminal 43 are respectively inserted into the hole 401, the hole 402, and the holes 403 to be fixed. Also, the photocathode side terminal 41 is made to electrically contact the first end 311*a* of the voltage distributing section 311, the anode terminal 42 is made to electrically contact with the anode 32 of the sidewall frame 3, and the anode side terminal 43 is made to electrically contact the second end 311*b* of the voltage distributing section 311.

Figure 3:
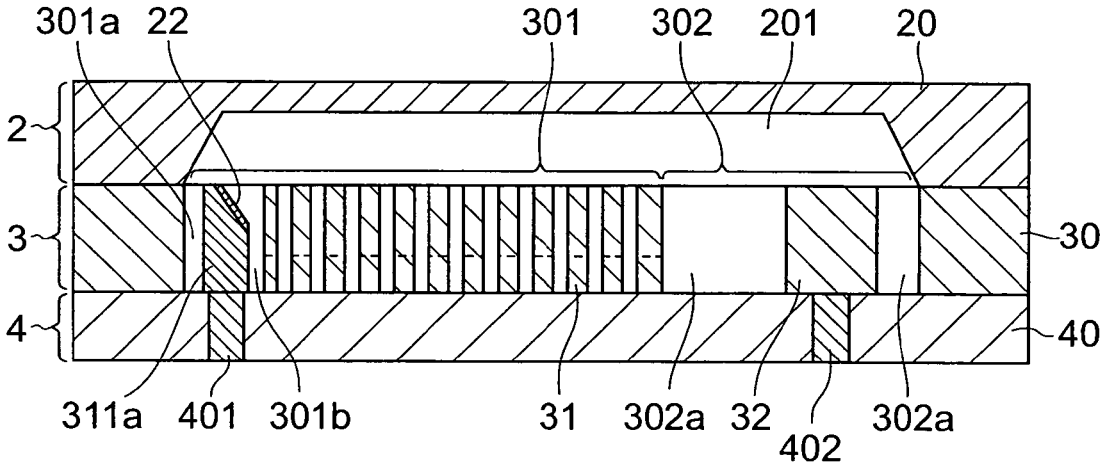
FIG. 3 illustrates cross-sectional views showing configurations of the photomultiplier taken along line I-I and line II-II respectively in FIG. 1.
Figure 3:
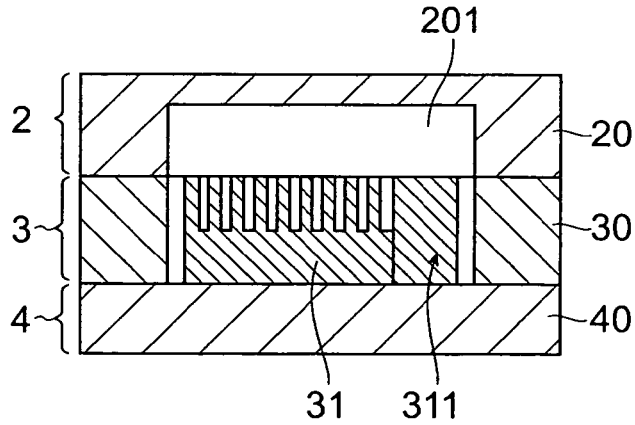

FIG. 3 is a cross-sectional view showing configurations of the photomultiplier 1*a* respectively taken along lines I-I and II-II in FIG. 1. In particular, in FIG. 3, the area (a) shows a configuration of the photomultiplier (FIG. 1) taken along line I-I, and the area (b) shows the photomultiplier taken along line II-II. As described above, the depressed portion 201 for defining the internal space of the housing is formed in the upper frame 2. By joining of the main surface 20*a* of the upper frame 2 (see FIG. 2) and the main surface 30*a* of the sidewall frame 3 (see FIG. 2), the upper frame 2 is fixed to the sidewall frame 3.

As shown in the area (a) of FIG. 3, the penetration portion 301 (at the electron-multiplier section 31 side) and the penetration portion 302 (at the anode 32 side) of the sidewall frame 3 are disposed at a position corresponding to the depressed portion 201 of the upper frame 2. The electron-multiplier section 31 is disposed along with a part of the voltage distributing section 311 in the penetration portion 301 of the sidewall frame 3, and the first end 311*a* of the voltage distributing section 311 is disposed so as to form a void part 301*a* between the sidewall frame 3 and the first end 311*a*, and to form a void part 301*b* between the first end 311*a* and the electron-multiplier section 31. The anode 32 is disposed in the penetration portion 302 of the sidewall frame 3 positioned at the electron emission terminal side of the electron-multiplier section 31. Since the anode 32 is disposed so as to not touch the inner wall of the penetration portion 302, void parts 302*a* are formed between the sidewall frame 3 and the anode 32, and between the electron-multiplier section 31 and the anode 32. In addition, a part of the voltage distributing section 311 including the second end 311*b* is disposed in the penetration portion 302. The first end 311*a* of the voltage distributing section 311 is positioned at the electron emission terminal side of the electron-multiplier section 31, and the photocathode 22 serving as a reflection type photocathode is provided onto the cut surface formed at the first end 311*a*. When an incident light passing through the upper frame 2 reaches the photocathode 22, photoelectrons corresponding to the incident light are emitted from the photocathode 22 toward the electron-multiplier section 31. In this way, the photocathode 22, the electron-multiplier section 31, the voltage distributing section 311, and the anode 32 are disposed in the penetration portion 301 and the penetration portion 302 surrounded by the inner wall of the sidewall frame 3, and these are joined to the main surface 40*a* of the lower frame 4 (see FIG. 2).

Note that the electron-multiplier section 31 is constituted by the dynodes at multiple stages sequentially disposed from the photocathode 22 toward the anode 32 in order to realize higher multiplication efficiency. These dynodes are electrically isolated because the respective stages are respectively set to different electric potentials. On the other hand, as shown in the area (b) of FIG. 3, a plurality of groove portions respectively constituting parts of different electron-multiplier channels are provided so as to have a bottom serving as a common portion to a dynode at a predetermined stage.

By joining of the surface 30*b* of the sidewall frame 3 (see FIG. 2) and the main surface 40*a* of the lower frame 4 (see FIG. 2), the lower frame 4 is fixed to the sidewall frame 3. At this time, the photocathode 22, the electron-multiplier section 31, the voltage distributing section 311, and the anode 32 of the sidewall frame 3 as well are joined to the lower frame 4. In accordance therewith, the photocathode 22, the electron-multiplier section 31, the voltage distributing section 311, and the anode 32 serving as the main components of the photomultiplier are mounted on the device mounting surface corresponding to the main surface 40*a* of the lower frame 4. By joining the upper frame 2 and the lower frame 4 respectively comprised of a glass material to the sidewall frame in a state of sandwiching the sidewall frame 3, the housing of the photomultiplier 1*a* can be obtained. Note that a space is formed inside the housing, vacuum-tight processing is performed at the time of assembling the housing composed of the upper frame 2, the sidewall frame 3, and the lower frame 4, which maintains the inside of the housing in a vacuum state (as will hereinafter be described in detail).

Since the photocathode side terminal 401 and the anode side terminal 403 of the lower frame 4 are respectively made to electrically contact the first and second ends 311*a* and 311*b* of the voltage distributing section 311, it is possible to generate an electric potential difference in the longitudinal direction of the silicon substrate 30 (a direction in which photoelectrons are emitted from the photocathode 22 and a direction in which secondary electrons travel in the electron-multiplier section 31) by applying predetermined voltages respectively to the photocathode side terminal 401 and the anode side terminal 403. Furthermore, because the anode terminal 402 of the lower frame 4 is made to electrically contact the anode 32 of the sidewall frame 3, electrons reaching the anode 32 can be taken out as signals.

Figure 4:
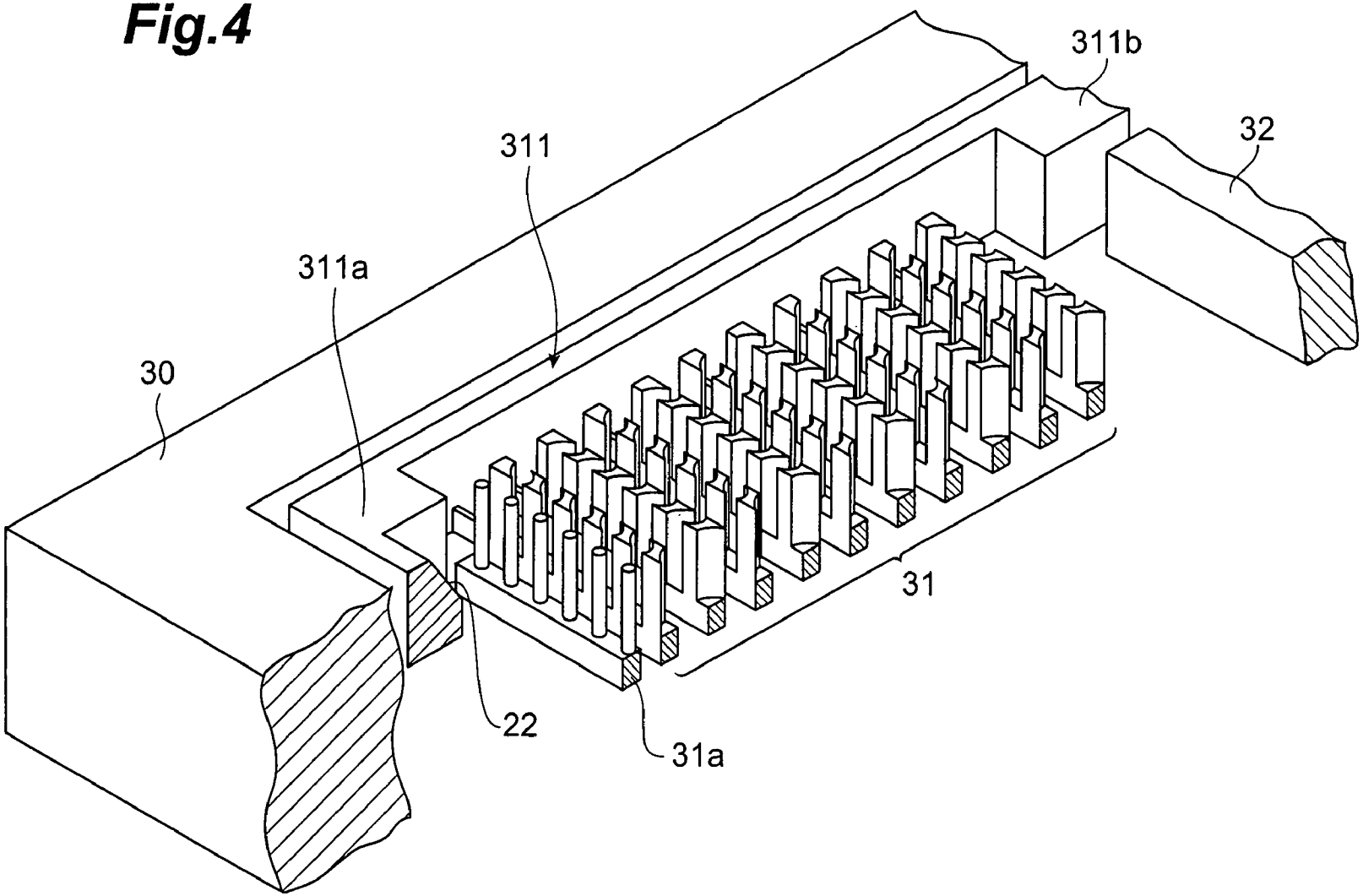
FIG. 4 is a perspective view showing a configuration of an electron-multiplier section in the photomultiplier shown in FIG. 1.

In FIG. 4, a configuration in the vicinity of the wall parts of the sidewall frame 3 is shown. The photocathode 22, the electron-multiplier section 31, the voltage distributing section 311, and the anode 32 are disposed in the penetration portion 301 of the silicon substrate 30. However, in the FIG. 4, a configuration in the vicinity of the photocathode 22 is mainly shown as a perspective view. The electron-multiplier section 31 is constituted by the dynodes at multiple stages sequentially disposed from the photocathode 22 toward the anode 32 in order to realize higher multiplication efficiency. These dynodes are electrically isolated because the respective stages are respectively set to different electric potentials. However, a plurality of groove portions constituting parts of different electron-multiplier channels at the same stage are electrically connected to one another so as to have a bottom serving as a common portion. Furthermore, the voltage distributing section 311 installed adjacent to the electron-multiplier section 31 has the main shaft part disposed parallel to the electron-multiplier section 31 and the connection parts respectively connected to the dynodes at the corresponding stages. In addition, these joint portions are respectively spaced by a predetermined distance from the photocathode 22 toward the anode 32, and when a predetermined voltage is applied between the first end 311*a* and the second end 311*b*, the dynodes at the respective stages are respectively set to different electric potentials due to a voltage drop in the main shaft part. Note that the photocathode 22 serving as a reflection type photocathode is formed on the cut surface of the first end 311*a* in the voltage distributing section 311, and a focusing electrode 31*a* for effectively guiding the photoelectrons from the photocathode 22 to the electron-multiplier section 31 is provided between the photocathode 22 and the electron-multiplier section 31. The focusing electrode 31*a* as well is electrically connected so as to have the bottom serving as a common portion.

The photomultiplier 1*a* operates as follows. That is, −1000V is applied to the photocathode side terminal 401 of the lower frame 4, and 0V is applied to the control electrode terminal 403, respectively. Note that a resistance of the silicon substrate 30 is about 10 MΩ. Also, a value of resistance of the silicon substrate 30 can be adjusted by changing a volume, for example, a thickness of the silicon substrate 30. For example, a value of resistance can be increased by making a thickness or width of the silicon substrate thinner. Here, when light is made incident into the photocathode 22 serving as a reflection type photocathode of the sidewall frame 3 via the upper frame 2 comprised of a glass material, photoelectrons are emitted from the photocathode 22 toward the focusing electrode 31*a*, and the photoelectrons passing through the focusing electrode 31*a* reach the electron-multiplier section 31. Since an electric potential difference is generated in the longitudinal direction of the silicon substrate 30 in the voltage distributing section 311, the photoelectrons reaching the electron-multiplier section 31 head for the anode 32 side. The electron-multiplier section 31 is constituted by the dynodes at multiple stages respectively having a plurality of groove portions as parts of different electron-multiplier channels. That is, the photoelectrons reaching the electron-multiplier section 31 from the photocathode 22 are sequentially multiplied in the groove portions in a dynode at each stage, and a plurality of secondary electrons are efficiently emitted. In this way, in the electron-multiplier section 31, cascade-multiplication of secondary electrons is carried out one after another, and $10^5$ to $10^7$ secondary electrons are generated per photoelectron reaching the electron-multiplier section from the photocathode. The generated secondary electrons reach the anode 32 to be taken out as signals from the anode terminal 402.

Next, various configurations of the electron-multiplier section 31 in the sidewall frame 3 will be described by using FIG. 5.

Figure 5:
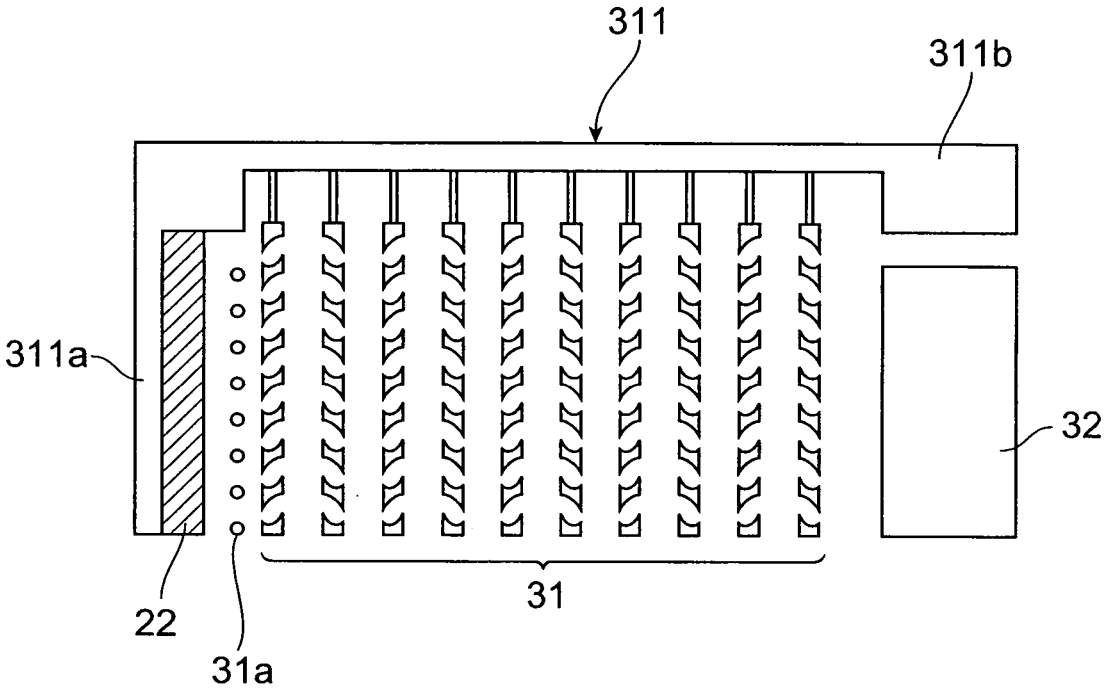
FIG. 5 illustrates plan views for explaining various configurations of the electron-multiplier section.
Figure 5:
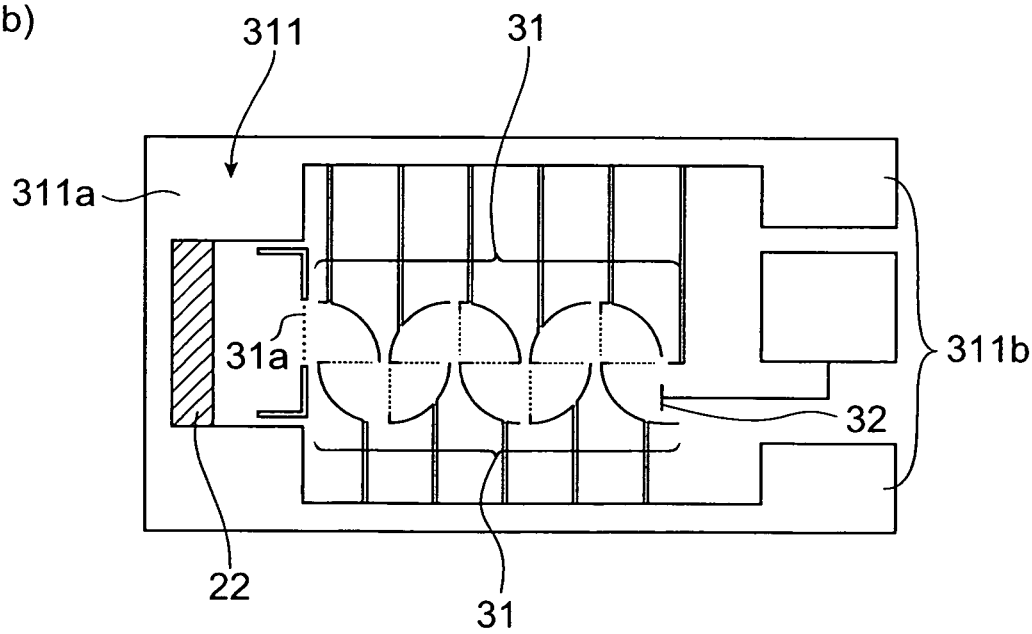

First, the area (a) of FIG. 5 is a plan view showing a configuration of the multi-channel electron-multiplier section constituted by the dynodes at multiple stages respectively having a plurality of groove portions as described above. In the electron-multiplier section 31 shown in the area (a) of FIG. 5, the dynodes at multiple stages respectively set to different electric potentials at each stage are sequentially disposed from the photocathode 22 to the anode 32. In addition, a plurality of groove potions are provided to a dynode at each stage, one electron-multiplier channel is constituted by groove portions aligned from the photocathode 22 to the anode 32 among the respective groove portions of the respective dynodes at multiple stages. Furthermore, a dynode at each stage is electrically connected to a connection part extending from the main shaft part of the voltage distributing section 311, and the dynodes are respectively set to different electric potentials due to a voltage drop between the first and second ends 311*a* and 311*b*. At this time, each connection part has a shape in which at least a thickness defined in a direction in which the main shaft part extends at the joint end with the main shaft part is made less than a width of a dynode at each stage defined in the direction in which the main shaft part extends. Since a continuous electric potential gradient is formed in the main shaft part of the voltage distributing section 311 in which the predetermined voltages have been applied to the both ends, in a case in which a thickness of the joint end of the connection part (joint portion between the main shaft part and the connection part) is great, it is difficult to set a dynode at each stage to a desired electric potential. However, it is easy to acquire a desired voltage at least by reducing a thickness of the joint end. Note that, a cross-sectional area of the connection part except for the joint end may be made greater in order to reduce electric resistance.

On the other hand, the electron-multiplier section 31 shown in the area (b) of FIG. 5 as well is composed of dynodes at multiple stages. However, this is different from the electron-multiplier section 31 having the configuration shown in the area (a) of FIG. 5 in the point that the electron-multiplier section 31 has a configuration in which respective electron entrance surfaces of dynodes at stages adjacent to one another from the photocathode 22 to the anode 32 face each other. Note that, in the configuration shown in this embodiment, a grid electrode is provided to an electrode incident opening of a dynode at each stage on and after the first stage, and the configuration is the same as that of the focusing electrode 31*a*. In this way, the photomultiplier according to the present invention may have an electron-multiplier section with a single channel. In this configuration as well, a cross-sectional area of a connection part is preferably smaller than a cross-sectional area of the main shaft part.

Note that, in the above-described embodiment, the reflection type photomultiplier has been described. However, the photomultiplier according to the present invention may have a transmission type photocathode. For example, a photomultiplier having a transmission type photocathode can be obtained by forming a photocathode at a position which is the bottom face of the depressed portion 201 of the upper frame 2 formed of a glass material, and corresponds to the electron entrance terminal of the electron-multiplier section 31, or by forming a transmission window at an end opposite the anode side terminal of the electron-multiplier section 31, and by further forming a transmission type photocathode so as to cover the transmission window. In either the reflection type or the transmission type structure, it is possible to obtain a photomultiplier according to the present invention in a state of having other structures which are the same as those of the photomultiplier 1*a*.

Also, in the above-described embodiment, the electron-multiplier section 31 disposed in the housing is formed integrally so as to be spaced from the silicon substrate 30 constituting the sidewall frame 3. Usually, in a state in which the sidewall frame 3 and the electron-multiplier section 31 contact each other, there is a possibility that the electron-multiplier section 31 is under the influence of external noise via the sidewall frame 3, which deteriorates detection accuracy. Therefore, in the present invention, the electron-multiplier section 31, voltage distributing section 311 and the anode 32 integrally formed with the sidewall frame 3 are respectively disposed at the glass substrate 40 (lower frame 4) so as to be spaced by a predetermined distance from the sidewall frame 3.

Furthermore, in the above-described embodiment, the upper frame 2 constituting a part of the housing is comprised of the glass substrate 20, and the glass substrate 20 itself functions as a transmission window. However, the upper frame 2 may be comprised of a silicon substrate. In this case, a transmission window is formed at any one of the upper frame 2 and the sidewall frame 3. As a method for forming a transmission window, for example, etching is carried out onto the both surfaces of an SOI (Silicon On Insulator) substrate in which the both surfaces of a glass layer ($SiO_2$) are sandwiched between silicon substrates, and an exposed part of the glass layer ($SiO_2$) can be utilized as a transmission window. Further, a columnar or mesh pattern is formed to be several μm on a silicon substrate, and this portion may be thermally oxidized to be glass. Further, etching may be carried out such that a silicon substrate of an area to be formed as a transmission window is made to have a thickness of about several μm, and this may be thermally oxidized to be glass. In this case, etching may be carried out from the both surfaces of the silicon substrate, etching may be carried out only from one side.

Next, one example of a method for manufacturing the photomultiplier 1*a* shown in FIG. 1 will be described. In a case of manufacturing the aforementioned photomultiplier, a silicon substrate of 4 inches in diameter (a constituent material of the sidewall frame 3 in FIG. 2) and two glass substrates of the same shape (constituent materials of the upper frame 2 and the lower frame 4 in FIG. 2) are prepared. Processes which will be hereinafter described are performed onto those each of minute area (for example, several millimeters to several tens of millimeters square). After the processes which will be hereinafter described are completed, they are divided into each area, which completes the photomultiplier. Subsequently, a method for the processes will be described by using FIG. 6 and FIG. 7.

Figure 6:
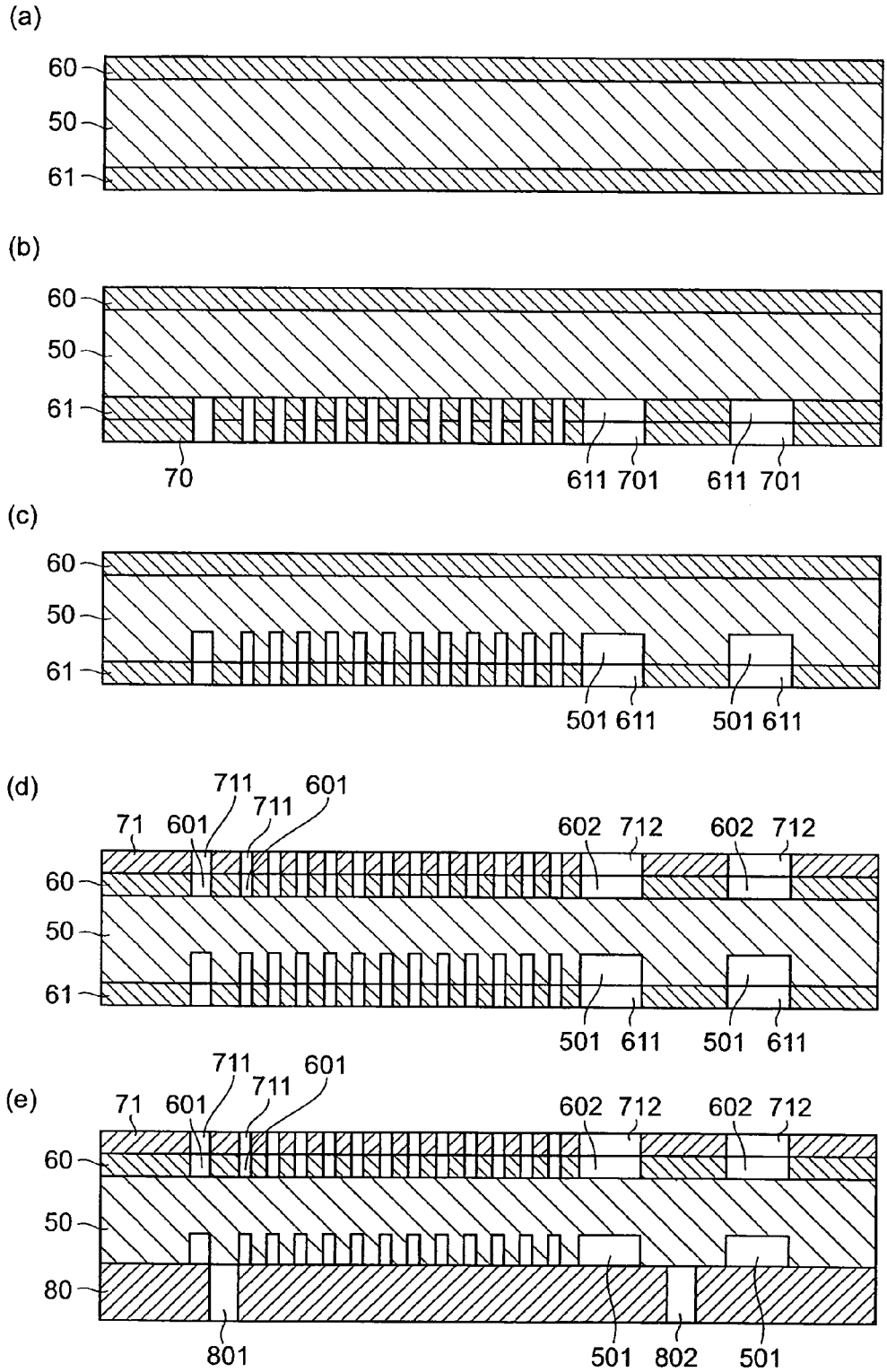
FIG. 6 illustrates diagrams for explaining manufacturing processes for the photomultiplier shown in FIG. 1 (part 1).

First, as shown in the area (a) of FIG. 6, a silicon substrate 50 (corresponding to the sidewall frame 3) with a thickness of 0.3 mm and a specific resistance of 30 kΩ·cm is prepared. A silicon thermally-oxidized film 60 and a silicon thermally-oxidized film 61 are respectively formed on the both surfaces of the silicon substrate 50. The silicon thermally-oxidized film 60 and the silicon thermally-oxidized film 61 function as masks at the time of a DEEP-RIE (Reactive Ion Etching) process. Next, as shown in the area (b) of FIG. 66B, a photoresist film 70 is formed on a back surface side of the silicon substrate 50. Removed portions 701 corresponding to the void parts 302*a* shown in the area (a) of FIG. 3 are formed in the photoresist film 70. At this time, removed portions corresponding to the void parts for isolating the dynodes at the respective stages constituting the electron-multiplier section 31 as well are formed. When etching onto the silicon thermally-oxidized film 61 is carried out in this state, removed portions 611 corresponding to the void parts 302*a* shown in the area (a) of FIG. 3 are formed, and removed portions corresponding to void parts of the dynodes at the respective stages as well are formed.

After the photoresist film 70 is removed from the state shown in the area (b) of FIG. 6, a DEEP-RIE process is performed. At this time, in a case in which the selectivity at the time of the DEEP-RIE process (an etching rate ratio of a place to be processed and a place not to be processed) is made higher, or a deep process is required, the photoresist film 70 is not removed, and may be used as a mask. As shown in the area (c) of FIG. 6, void parts 501 corresponding to the void parts 302*a* in the area (a) of FIG. 3, and void parts corresponding to the void parts 301*a* and 301*b* are formed in the silicon substrate 50. Next, as shown in the area (d) of FIG. 6, a photoresist film 71 is formed on the surface side of the silicon substrate 50. Removed portions 711 corresponding to the void parts 301*a* and 301*b* shown in the area (a) of FIG. 3, removed portions 712 corresponding to the void parts 302*a* shown in the area (a) of FIG. 3, and removed portions corresponding to the void parts among the dynodes at the respective stages are formed in the photoresist film 71. When etching onto the silicon thermally-oxidized film 60 is carried out in this state, removed portions 601 corresponding to the void parts 301*a* and 301*b* shown in the area (a) of FIG. 3, removed portions 602 corresponding to the void parts 302*a* shown in the area (a) of FIG. 3, and removed portions corresponding to the void parts among the dynodes at the respective stages are formed.

After the silicon thermally-oxidized film 61 is removed from the state shown in the area (d) of FIG. 6, anode joining of a glass substrate 80 (corresponding to the lower frame 4) onto the back surface side of the silicon substrate 50 is carried out (see the area (e) of FIG. 6). A hole 801 corresponding to the hole 401 in FIG. 2 and a hole 802 corresponding to the hole 402 in FIG. 2 are processed in advance in the glass substrate 80. Note that, although not shown in the figure, a hole 803 corresponding to the hole 403 in FIG. 2 as well is processed in advance to be adjacent to the hole 802. Next, a DEEP-RIE process is performed on the surface side of the silicon substrate 50. The photoresist film 71 functions as a mask material at the time of a DEEP-RIE process, which makes it possible to process at a high aspect ratio. After the DEEP-RIE process, the photoresist film 71 and the silicon thermally-oxidized film 61 are removed. As shown in the area (a) of FIG. 7, by forming penetration portions reaching the glass substrate 80 with respect to the portions onto which the process for the void parts 501 has been performed in advance from the back surface, an island shaped portion 502 corresponding to the anode 32 in FIG. 2 is formed. This island shaped portion 502 corresponding to the anode 32 is joined to the glass substrate 80. Also, at the time of the DEEP-RIE process, portions 51 corresponding to the dynodes at the respective stages and an island shaped portion 502 corresponding to the first end 311*a* of the voltage distributing section 311 are formed. Here, secondary electron emission surfaces are formed on the groove portions and the bottom provided to the respective dynode portions 51. At this time, a cut surface is formed at the island shaped portion 503, and the reflection type photocathode 22 is formed on the cut surface (see the area (c) of FIG. 7).

Subsequently, as shown in the area (b) of FIG. 7, a glass substrate 90 corresponding to the upper frame 2 is prepared. A depressed portion 901 (corresponding to the depressed portion 201 in FIG. 2) is formed by a spot-facing process in the glass substrate 90.

Figure 7:
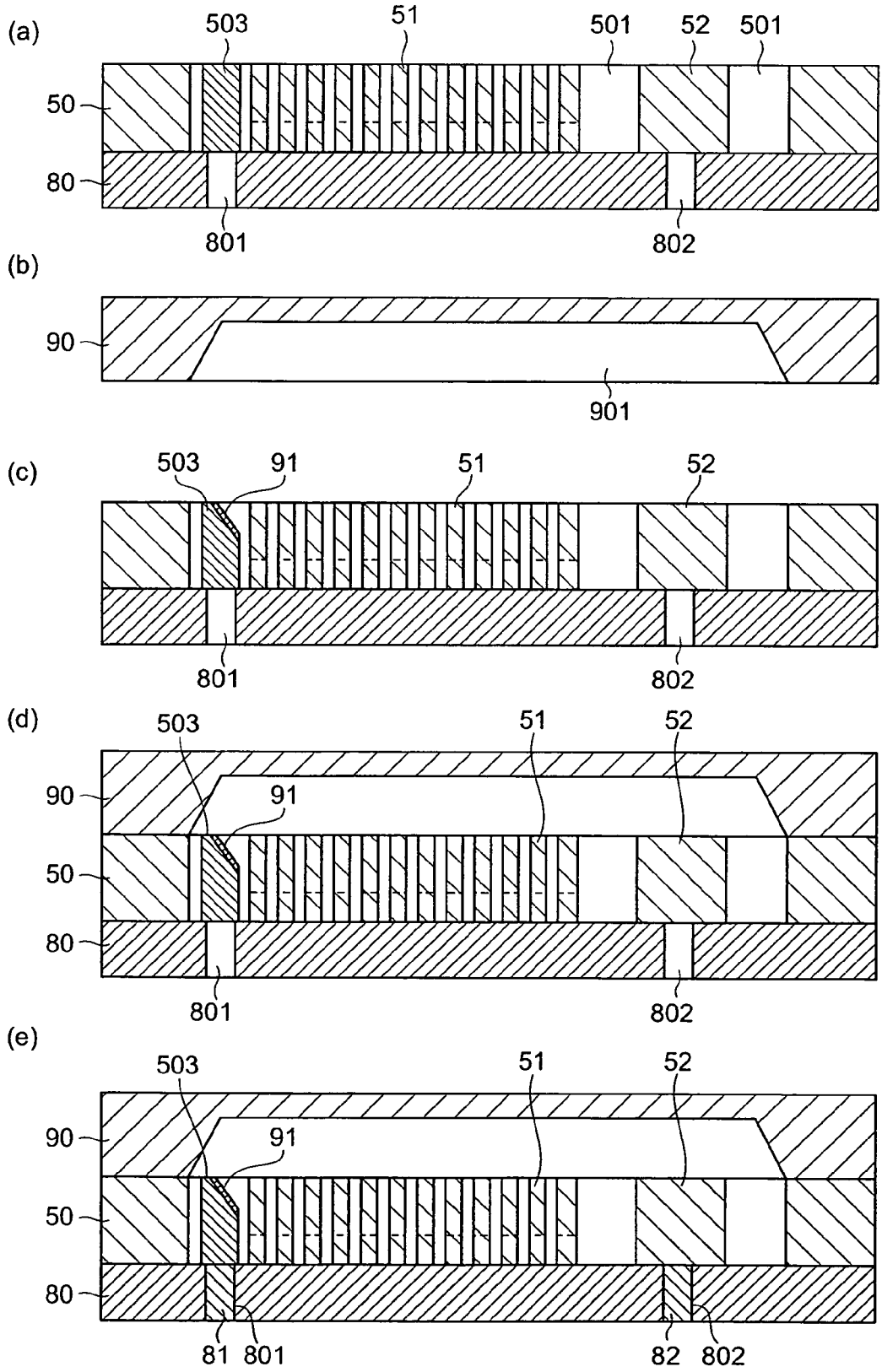
FIG. 7 illustrates diagrams for explaining manufacturing processes for the photomultiplier shown in FIG. 1 (part 2).

As described above, the silicon substrate 50 and the glass substrate 80 which have been made to progress up to the process shown in the area (c) of FIG. 7, and the glass substrate 90 which has been made to progress up to the process shown in the area (b) of FIG. 7 are joined in a vacuum-tight state as shown in the area (d) of FIG. 7. Thereafter, a photocathode side terminal 81 corresponding to the photocathode side terminal 41 in FIG. 2 is inserted into the hole 801 to be fixed, an anode terminal 82 corresponding to the anode terminal 42 in FIG. 2 is inserted into the hole 802 to be fixed, and anode side terminals 83 (not shown) corresponding to the anode side terminals 43 in FIG. 2 are inserted into the holes 803 to be fixed, respectively, which leads to a state shown in the area (e) of FIG. 7. Thereafter, due to this being cut out in units of chips, a photomultiplier having a configuration as shown in FIG. 1 and FIG. 2 can be obtained.

Figure 8:
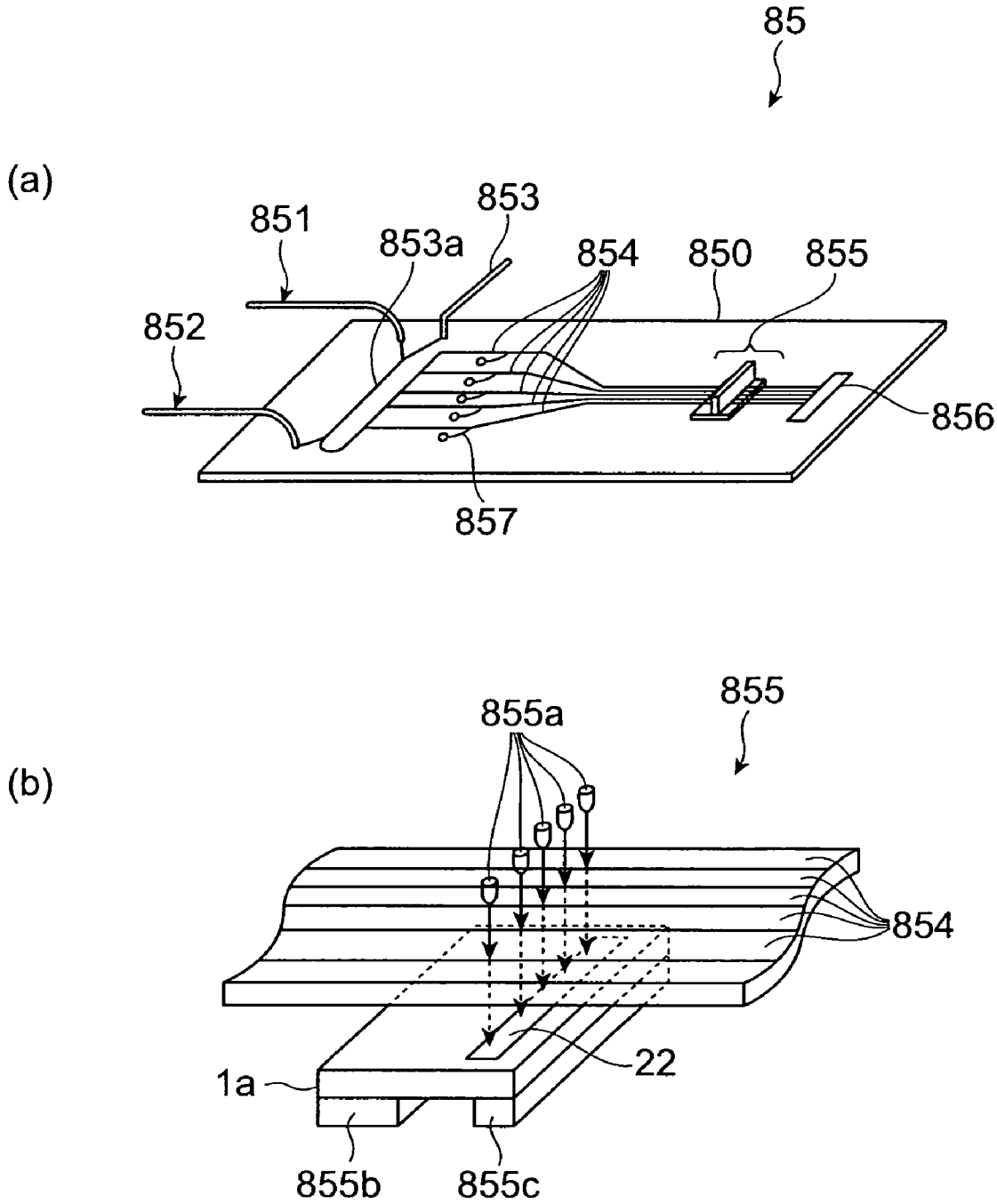
FIG. 8 illustrates diagrams showing configurations of a detection module to which the photomultiplier according to the present invention is applied.

Next, an optical module to which the photomultiplier 1*a* having a configuration as described above is applied will be described. The area (a) of FIG. 8 is a view showing a configuration of an analysis module to which the photomultiplier 1*a* has been applied. The analysis module 85 comprises a glass plate 850, a gas inlet pipe 851, a gas exhaust pipe 852, a solvent inlet pipe 853, reagent mixing-reaction paths 854, a detecting element 855, a waste liquid pool 856, and reagent paths 857. The gas inlet pipe 851 and the gas exhaust pipe 852 are provided to introduce or exhaust a gas serving as an object to be analyzed to or from the analysis module 85. The gas introduced from the gas inlet pipe 851 passes through an extraction path 853*a* formed on the glass plate 850, and is exhausted to the outside from the gas exhaust pipe 852. That is, by making a solvent introduced from the solvent inlet pipe 853 pass through the extraction path 853*a*, when there is a specific material of interest (for example, environmental hormones or fine particles) in the introduced gas, it is possible to extract it in the solvent.

The solvent which has passed through the extraction path 853*a* is introduced into the reagent mixing-reaction paths 854 so as to include the extract material of interest. There are a plurality of the reagent mixing-reaction paths 854, and due to corresponding reagents being introduced into the respective paths from the reagent paths 857, the reagents are mixed into the solvent. The solvent into which the reagents have been mixed travels toward the detecting element 855 through the reagent mixing-reaction paths 854 while carrying out reactions. The solvent in which detection of the material of interest has been completed in the detecting element 855 is discarded to the waste liquid pool 856.

A configuration of the detecting element 855 will be described with reference to the area (b) of FIG. 8. The detecting element 855 comprises a light-emitting diode array 855*a*, the photomultiplier 1*a*, a power supply 855*c*, and an output circuit 855*b*. In the light-emitting diode array 855*a*, a plurality of light-emitting diodes are provided to correspond to the respective reagent mixing-reaction paths 854 of the glass plate 850. Pumping lightwaves (solid line arrows in the figure) emitted from the light-emitting diode array 855*a* are guided into the reagent mixing-reaction paths 854. The solvent in which a material of interest can be included is made to flow in the reagent mixing-reaction paths 854, and after the material of interest reacts to the reagent in the reagent mixing-reaction paths 854, pumping lightwaves are irradiated onto the reagent mixing-reaction paths 854 corresponding to the detecting element 855, and fluorescence or transmitted light (broken-line arrows in the figure) reach the photomultiplier 1*a*. This fluorescence or transmitted light is irradiated onto the photocathode 22 of the photomultiplier 1*a*.

As described above, since the electron-multiplier section having a plurality of grooves (for example, in number corresponding to twenty channels) is provided to the photomultiplier 1*a*, it is possible to detect from which position (from which reagent mixing-reaction path 854) fluorescence or transmitted light has changed. This detected result is outputted from the output circuit 855*b*. In addition, the power supply 855*c* is a power supply for driving the photomultiplier 1*a*. Note that, a glass substrate (not shown) is disposed on the glass plate 850, and covers the extraction path 853*a*, the reagent mixing-reaction paths 854, the reagent paths 857 (except for the sample injecting portions) except for the contact portions between the gas inlet pipe 851, the gas exhaust pipe 852, and the solvent inlet pipe 853, and the glass plate 850, the waste liquid pool 856, and sample injecting portions of the reagent paths 857.

As described above, due to the plurality of dynodes constituting the electron-multiplier section 31 being disposed two-dimensionally, it is possible to obtain a photomultiplier having a fine structure capable of dramatically improving the electron-multiplication efficiency.

Furthermore, since the grooves are formed in the electron-multiplier section 31 by performing microfabrication onto the silicon substrate 30*a*, and the silicon substrate 30*a* is joined to the glass substrate 40*a*, there is no vibratory portion. That is, the photomultiplier according to the respective embodiments is excellent in vibration resistance and impact resistance.

Since the anode 32 is joined to the glass substrate 40*a*, there is no metal droplet at the time of welding. Therefore, the photomultiplier according to the respective embodiments is improved in electrical stability, vibration resistance, and impact resistance. Since the anode 32 is joined to the glass substrate 40*a* at the entire bottom face thereof, the anode 32 does not vibrate due to impact and vibration. Therefore, the photomultiplier is improved in vibration resistance and impact resistance.

Furthermore, in the manufacture of the photomultiplier, because there is no need to assemble the internal structure, and handling thereof is simple and work hours are shortened. Since the housing (vacuum case) comprises the upper frame 2, the sidewall frame 3, and the lower frame 4, and the internal structure are integrally built, it is possible to easily downsize the photomultiplier. Since there are no separate components internally, electrical and mechanical joining is not required.

The electron-multiplier section 31 is constituted by the dynodes at multiple stages disposed in a planar manner, and cascade-multiplication of electrons is carried out while electrons collide against the plurality of groove portions provided to the dynodes at the respective stages. In this way, since the aforementioned photomultiplier has a planar structure which does not require a large number of components, it is possible to easily downsize the photomultiplier.

In accordance with the analysis module 85 to which the photomultiplier having a configuration as described above is applied, it is possible to detect minute particles. In addition, it is possible to continuously carry out extraction, reaction, and detection.

From the invention thus described, it will be obvious that the embodiments of the invention may be varied in many ways. Such variations are not to be regarded as a departure from the spirit and scope of the invention, and all such modifications as would be obvious to one skilled in the art are intended for inclusion within the scope of the following claims.

INDUSTRIAL APPLICABILITY

The photomultiplier according to the present invention can be applied to various fields of detection requiring detection of low light.

The invention claimed is:

1. A photomultiplier, comprising:

a housing whose internal space, defined by an inner wall surface including a device mounting surface, is maintained in a vacuum state;

a photocathode, accommodated in the internal space of said housing, emitting electrons to an inside of said housing in response to light taken in via said housing;

an electron-multiplier section, accommodated in the internal space of said housing while being disposed on the device mounting surface, said electron-multiplier section having dynodes at multiple stages sequentially disposed on the device mounting surface along an electron traveling direction;

an anode, accommodated in the internal space of said housing while being disposed on the device mounting surface, said anode taking out, as signals, electrons having reached among electrons cascade-multiplied in said electron-multiplier section; and a voltage distributing section, accommodated in the internal space of said housing, applying a predetermined voltage to each of the dynodes at multiple stages constituting said electron-multiplier section, said voltage distributing section being disposed on the device mounting surface together with said electron-multiplier section and said anode while being separated from the inner wall of said housing excluding the device mounting surface.

2. A photomultiplier according to claim 1, wherein said voltage distributing section has a main shaft extending along the electron traveling direction in said electron-multiplier section, and a plurality of connection parts which respectively extend from said main shaft part and whose one ends are respectively connected to dynodes at corresponding stages among the dynodes at multiple stages.

3. A photomultiplier according to claim 2, wherein each of said plurality of connection parts is formed such that at least a thickness at a joint end with said main shaft part, defined in a direction in which the main shaft part extends, is made less than a width of a dynode at each stage defined in the direction in which said main shaft part extends.

4. A photomultiplier according to claim 1, wherein each of the dynodes at multiple stages has a plurality of groove portions disposed along the device mounting surface.

5. A photomultiplier according to claim 2, wherein metal terminals for applying predetermined voltages to said electron-multiplier section are connected to both ends of said main shaft part in said voltage distributing section.

6. A photomultiplier according to claim 1, wherein said electron-multiplier section is comprised of silicon.

7. A photomultiplier according to claim 3, wherein metal terminals for applying predetermined voltages to said electron-multiplier section are connected to both ends of said main shaft part in said voltage distributing section.

* * * * *